US008220086B2

(12) United States Patent
Geiger

(10) Patent No.: US 8,220,086 B2
(45) Date of Patent: Jul. 17, 2012

(54) BED FRAME ASSEMBLY

(76) Inventor: Joseph E. Geiger, Hinsdale, IL (US)

( * ) Notice: Subject to any disclaimer, the term of this patent is extended or adjusted under 35 U.S.C. 154(b) by 0 days.

(21) Appl. No.: 12/959,431

(22) Filed: Dec. 3, 2010

(65) Prior Publication Data

US 2012/0137430 A1 Jun. 7, 2012

(51) Int. Cl.
*A47C 19/04* (2006.01)
*A47C 19/00* (2006.01)

(52) U.S. Cl. ..... 5/201; 5/282.1; 5/202

(58) Field of Classification Search ..... 5/200.1, 5/201, 202, 203, 207, 208, 238, 282.1, 285, 5/286
See application file for complete search history.

(56) References Cited

U.S. PATENT DOCUMENTS

| | | | | |
|---|---|---|---|---|
| 2,772,424 | A | 12/1956 | Roche et al. | |
| 2,882,535 | A | 4/1959 | Sands | |
| 2,883,222 | A | 4/1959 | Sands | |
| 2,883,680 | A | 4/1959 | Roche | |
| 2,900,647 | A | 8/1959 | Sands | |
| 3,961,383 | A | 6/1976 | Spitz | |
| 3,984,884 | A * | 10/1976 | Spitz | 5/176.1 |
| 4,007,502 | A | 2/1977 | Mis | |
| 4,027,343 | A * | 6/1977 | Hooker | 5/200.1 |
| 4,038,710 | A | 8/1977 | Tambascio | |
| 5,996,145 | A | 12/1999 | Taylor | |
| 6,851,140 | B2 | 2/2005 | Polevoy | |
| 7,223,043 | B1 | 5/2007 | Andrews | |
| 7,437,783 | B2 * | 10/2008 | Navarro et al. | 5/201 |
| 7,644,456 | B2 | 1/2010 | Polevoy et al. | |
| 2008/0168602 | A1 * | 7/2008 | DiForio | 5/184 |

FOREIGN PATENT DOCUMENTS

EP 9002 A1 * 3/1980

* cited by examiner

*Primary Examiner* — Michael Trettel
(74) *Attorney, Agent, or Firm* — Erickson Law Group, PC

(57) ABSTRACT

A bed frame assembly that can be assembled without additional tools. The bed frame assembly has two tubular side rails spaced a distance apart and arranged parallel to each other. The side rails are spaced apart for a distance at least equal to the length of a cross support member. Cross support members span the cross-support length between the tubular rails to support a mattress or a box spring over the distance between the two side rails. Retaining members which are used to secure the cross support members in position extend from opposing sides of the tubular side rail pair. The retaining members and the cross support members interlock via a releasable joint mechanism. The position of the releasable joint mechanism can vary to allow for adjustability in the cross support length to accommodate mattresses of different sizes.

21 Claims, 13 Drawing Sheets

BED FRAME ASSEMBLY

FIELD OF THE INVENTION

This invention relates in general to bed frames, and in particular tubular bed frames that can be assembled without the use of additional tools.

BACKGROUND OF THE INVENTION

Bed frames typically have side rails and several cross support members which span the distance across side rails to support a mattress and box spring. Due to its large size, bed frames are typically stored and shipped in a disassembled state to provide for ease of handling and to save storage space. Once delivered, the bed frame is assembled by delivery men or the end user.

Bed frames are often difficult to assemble due to the various components involved as well as due to the larger size of the components. The assembly of a bed frame requires securing together the components of the bed frame with various fastening mechanisms. Various hand tools are required to tighten screws, nuts, bolts, and other fastening mechanisms, each of which may require a distinct tool. Users self-assembling a bed frame may not have the array of tools needed for putting together the bed frame. As such, manufacturers may include a set of tools along with the bed frame. Such inclusion of tools, and the subsequent assembling of the bed frame may be cumbersome for individuals, due to having to follow assembly instructions and identifying and laying out fastening mechanisms and their assembly tools. As an alternate to self assembly, delivery men are often tasked with the assembly of the bed frame. However, due to having to assemble bed frames at various delivery locations, tools may be misplaced from one delivery location to another. Furthermore, the assembly of bed frames that require specific tools is cumbersome in general. Eliminating the need for additional tools during assembly would improve efficiency.

The present inventor has recognized the need for a bed frame assembly that can be easily assembled and/or disassembled without the use of any tools.

The present inventor has recognized the need for a bed frame assembly that can be adjusted to accommodate mattresses of different sizes.

The present inventor has recognized the need for a bed frame assembly that is cost efficient and capable of bearing more strength than traditional angled steel bed frames.

SUMMARY OF THE INVENTION

In one embodiment, the bed frame assembly comprises two tubular side rails spaced a distance apart and arranged parallel to each other. The side rails are spaced apart for a distance at least equal to the length of a cross support member. A plurality of cross support members spans the cross-support length between the tubular rails to support a mattress or a box spring over the distance between the two side rails. Retaining members which are used to secure the cross support members in position extend from opposing sides of the tubular side rail pair. The cross-support members are tubular with a rectangular cross section just larger than the cross-sectional dimension of the retaining members such that the retaining members can fit into the cross-support members. The ends of the cross-support members overlap with at least a portion of the retaining members. The retaining members and the cross support members interlock via a releasable joint mechanism. In one embodiment, cross-support members have apertures which engage with retractable protrusions extending from the retaining members. To disengage the retaining members from the cross-support member, the user depresses the protrusions until the protrusions recede to disengage with the aperture. The user slides the cross-support member and the retaining member away from each other. The retractable springing protrusions which extend from the retaining members are protrusions on the ends of spring clips which extend from apertures on the sides of the retaining members.

In another embodiment, the bed frame assembly comprises cross-support members with more than one positioning aperture which engages with the retaining members to allow the distance between the tubular side rails to be adjusted. The positioning aperture corresponding to the desired cross support length is selected for engagement with the retaining members.

In an alternate embodiment, the cross-support length comprises side support cross members and at least a portion of the central cross-support member. Adjustability between the side support cross member and the central cross support member is due to the protrusions on the central cross support member engaging with the positioning apertures on the side support cross member to provide for the full desired cross support length. The cross-support length can further comprise at least a portion of the retaining member. Retaining members may extend from the tubular side rails such that protrusions from the retaining members can also participate in the adjustable engagement of the positioning apertures of the side support cross member.

Numerous other advantages and features of the present invention will be become readily apparent from the following detailed description of the invention and the embodiments thereof, from the claims and from the accompanying drawings.

DETAILED DESCRIPTION OF THE PREFERRED EMBODIMENTS

Figure 1:
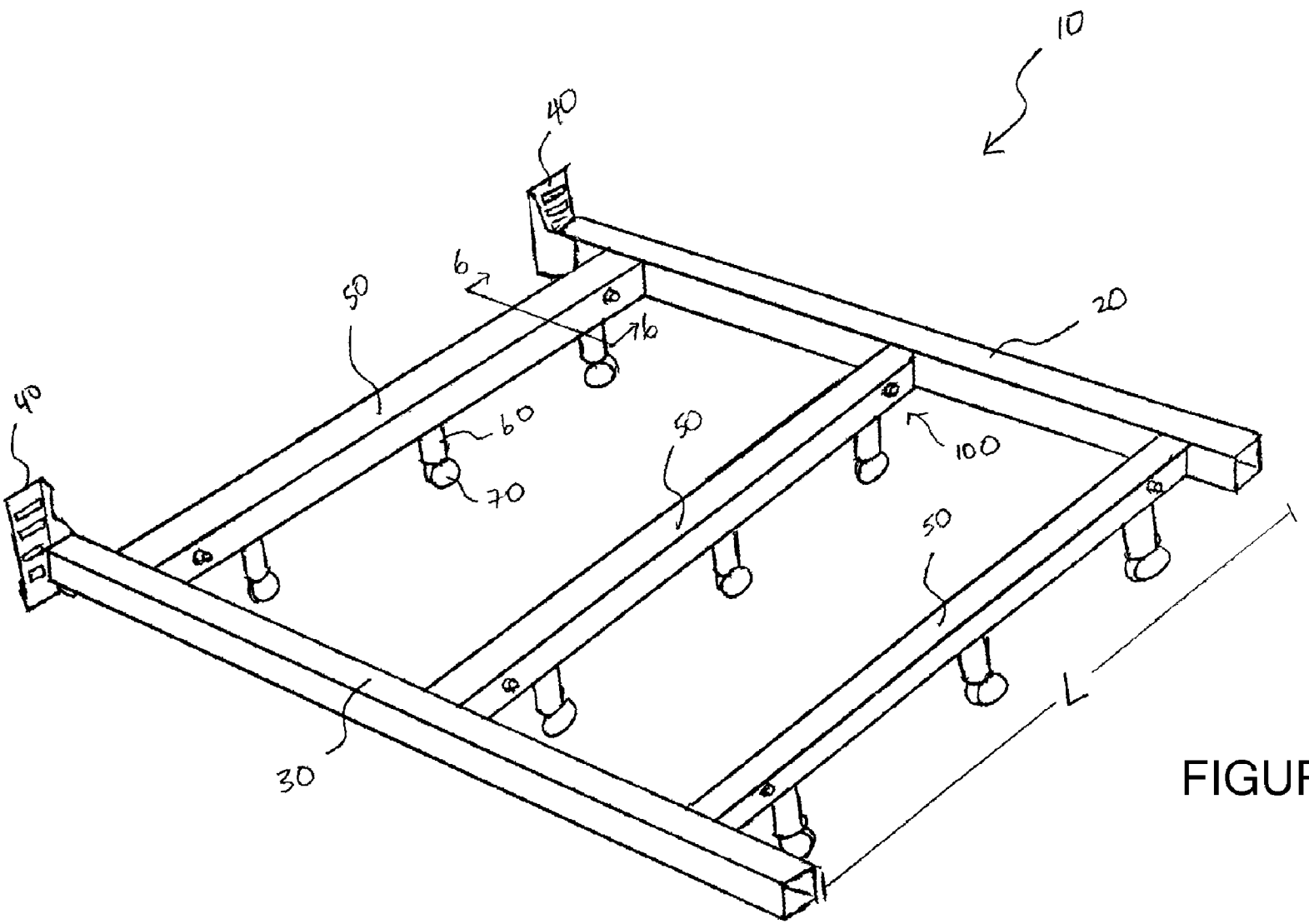
FIG. 1 is a perspective view of one exemplary embodiment of the bed frame assembly in its assembled state.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates one embodiment of a bed frame assembly in its assembled state. The bed frame assembly comprises tubular side rails 20, 30 spaced apart and arranged parallel to each other. The side rails 20, 30 are spaced apart for a distance at least equal to the length of a cross support member 50. A plurality of cross support members 50 span the distance between the tubular rails to support a mattress or a box spring. The distance "L" between the tubular rails is the cross support length. As illustrated in FIG. 1, the length of the cross support member 50 is the cross support length because the cross support member 50 spans the entire distance between the tubular rails. If the engagement of the cross support member 50 with the retaining member 110 (FIG. 2) exposes a portion of the retaining member, at least a portion of the retaining member 110 contributes to the cross support length. At one end of the side rails 20, 30 are slots 40 for engaging with a headboard. A releasable joint 100 connects the cross support members 50 to the side rails 20, 30.

Figure 2:
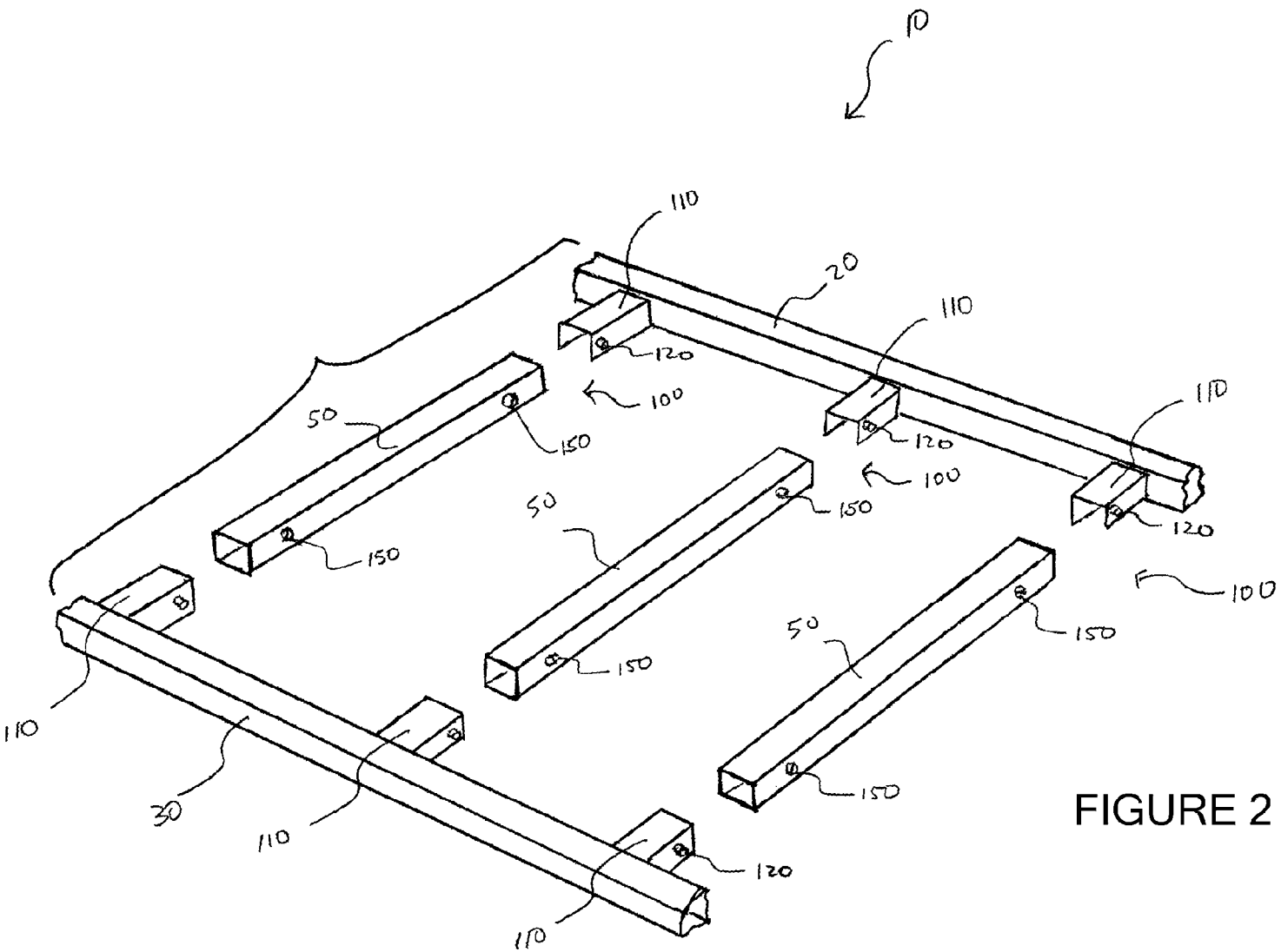
FIG. 2 is an exploded view of the embodiment of the bed frame of FIG. 1.

FIG. 2 illustrates the tubular rails 20, 30 and the cross support members 50 in exploded view. As illustrated in FIG. 2, the releasable joint 100 comprises a retaining member 110 with protrusions 120 which engage with apertures 150 on the cross support bar. The retaining member 110 extends from opposing sides of the tubular side rail 20, 30. The retaining member may extend any suitable distance from the tubular rails, for example 7.5 cm, or 10 cm, or for distances greater than 10 cm to provide for length adjustability of the cross support length. Protrusions can extend from the retaining member at any suitable distance along the length of the retaining member.

Figure 13:
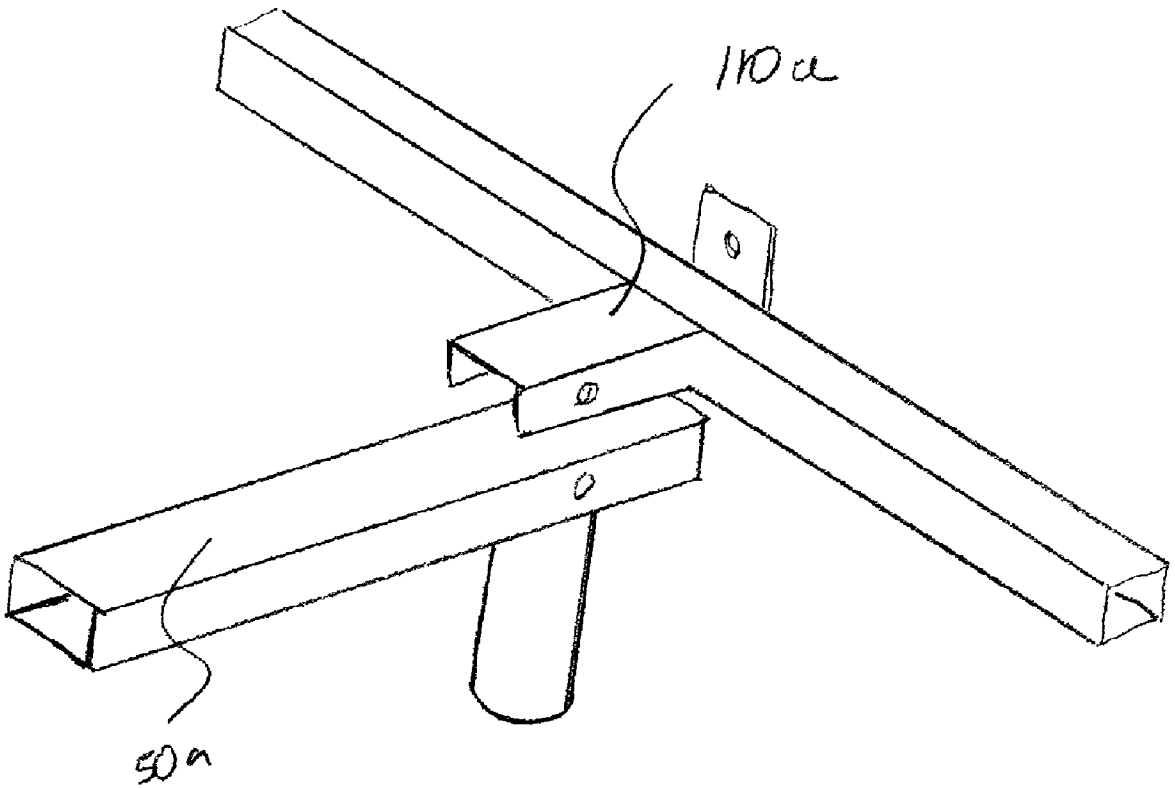
FIG. 13 is a perspective view of yet an alternate embodiment of the bed frame assembly.

In one embodiment, the cross support members 50 are tubular with a rectangular cross section just slightly larger than the cross-sectional dimension of the retaining members 110 such that the retaining members 110 can slide into the cross-support members 50 so that at least a portion of the cross-support member 50 overlaps with at least a portion of the retaining members 110. The retaining members and the cross support members interlock via a releasable joint mechanism 100. Cross-support members 50 have apertures 150 which engage with retractable springing protrusions 120 on the retaining members. To disengage the retaining members 110 from the cross-support member 50, the user presses on the protrusions 120 until they depress such that the protrusions recess from the aperture 150 to no longer engage with the aperture 150. The cross support member 50 and the retaining member 110 slide apart from each other once the protrusion 120 no longer engages with the aperture 150. FIG. 13 illustrates another embodiment of the bed frame assembly wherein the cross support member 50*a* is disposed underneath the retaining member 110*a*. Protrusions can extend from the cross support member 50*a* for engagement with apertures that are on the retaining member 110*a*. Alternatively, the protrusions can extend from the retaining member 110*a* for engagement with the apertures on the cross support member 50*a*. The joint can be assembled by having protrusions on the retaining member 110 extend into the inverted U-shaped region, towards each other, such that engagement with the cross support member 50*a* protrusions is possible without having spring clips, as illustrated in FIG. 3, from getting in the way of allowing the cross support bar 50*a* from making contact with the retraining member 110*a*.

Figure 3:
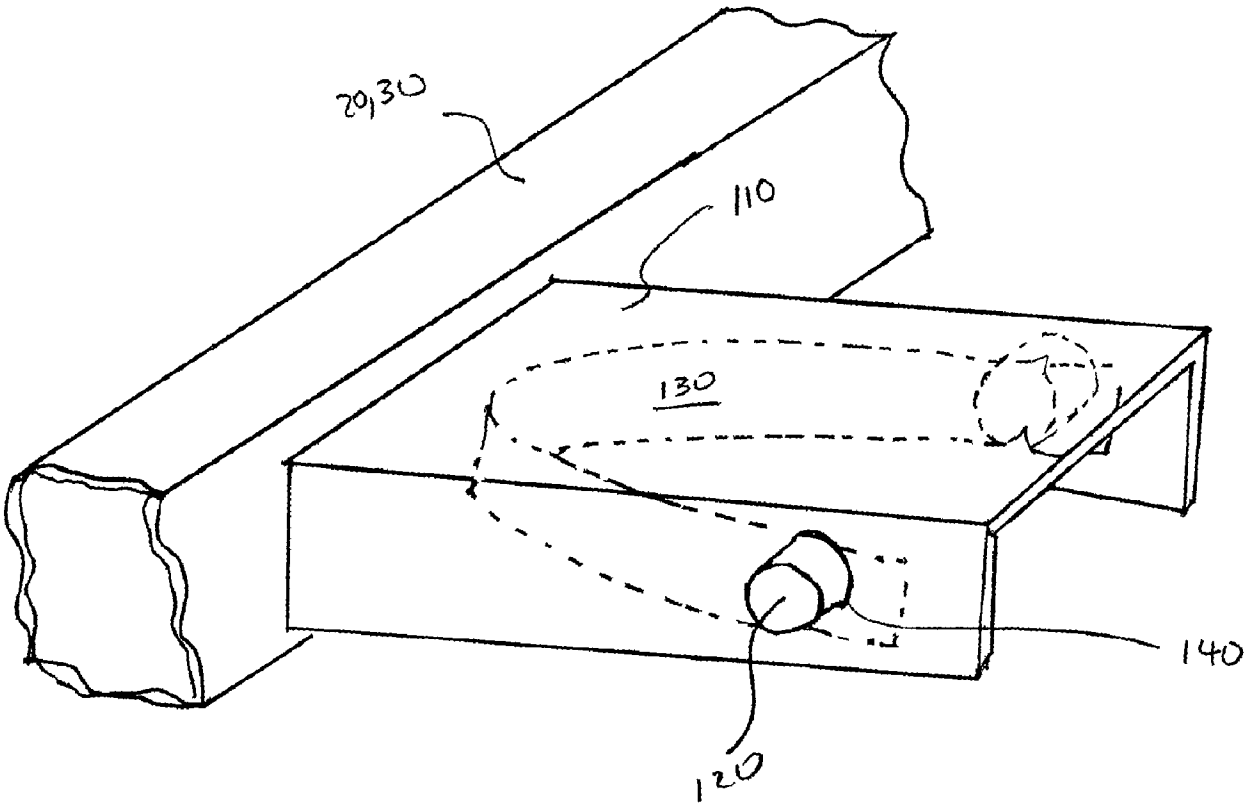
FIG. 3 is a perspective view of one exemplary embodiment of the retaining member.

FIG. 3 is an enlarged perspective view of the retaining member 110 and the protrusions 120. Each retaining member 110 has at least a pair of protrusions which extend on opposite sides of the retaining member 110. Each protrusion extends through a retaining member aperture 140. The protrusions are on ends of a spring clip 130, and are held in place to extend through the aperture 140 due to a spring force from the spring clip 130. Protrusions can also be arranged such that the face towards each other into the region defined within the retaining member.

Figure 4:
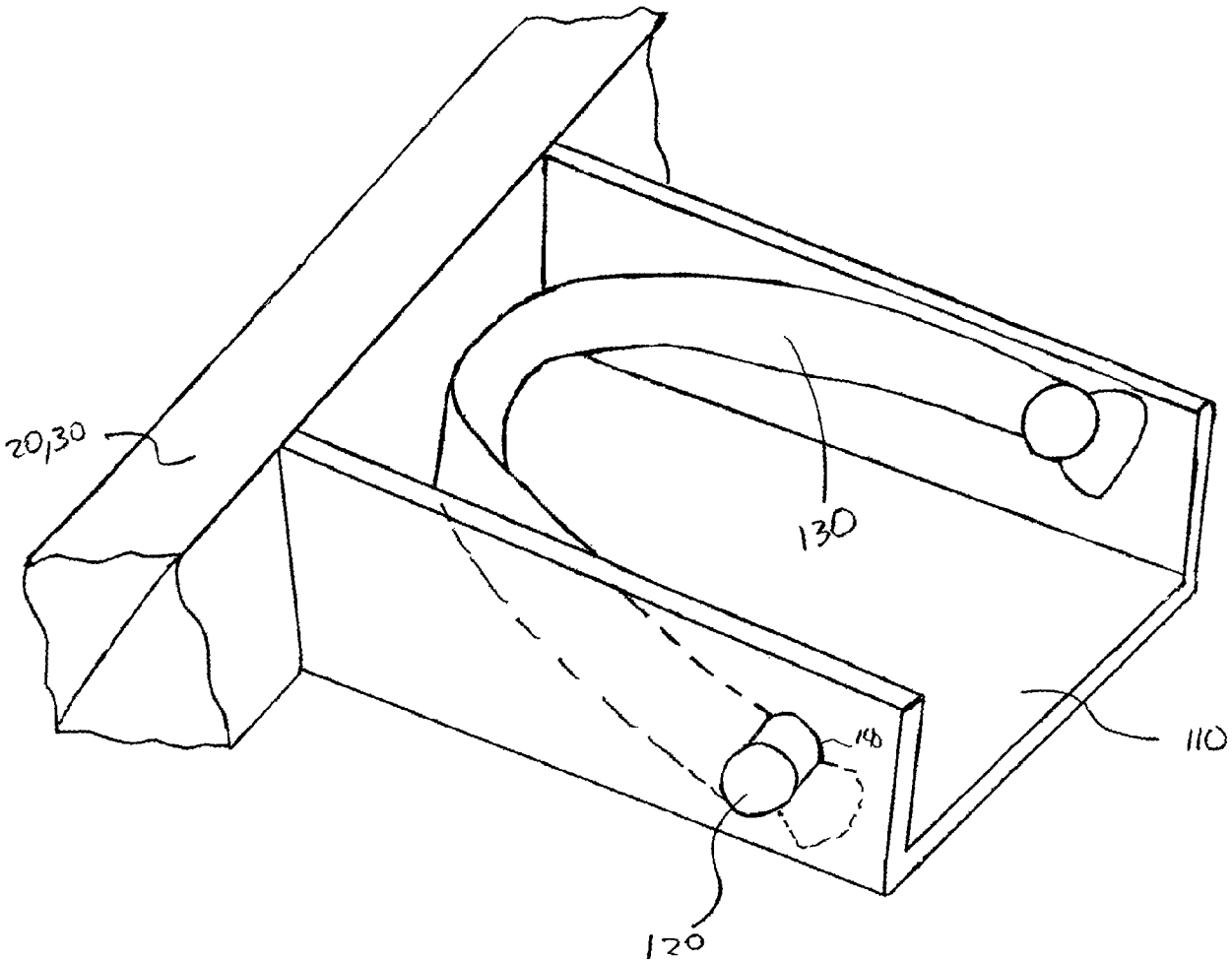
FIG. 4 is a perspective view of the underside of one exemplary embodiment of the retaining member.
Figure 5B:
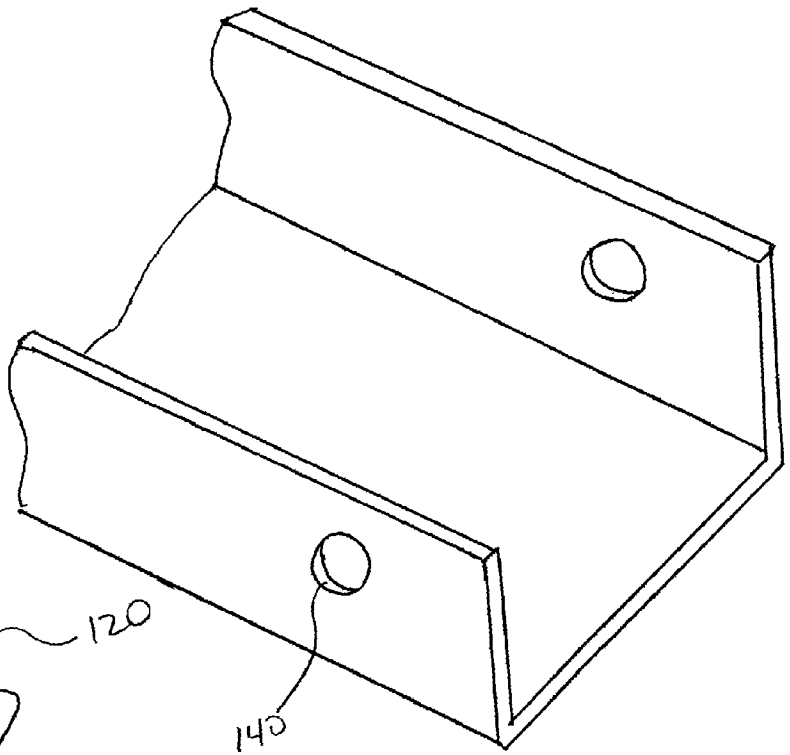
FIG. 5B is a perspective view of the one exemplary embodiment of the retaining member with the spring clip removed.
Figure 5A:
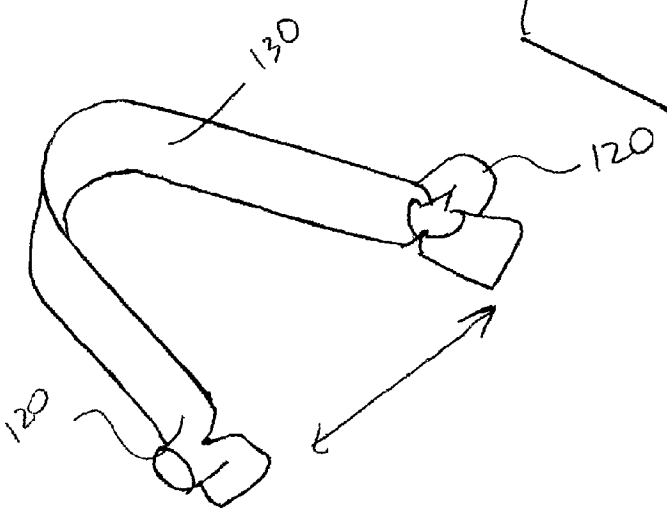
FIG. 5A is a perspective view of one exemplary embodiment of the spring clip.

FIG. 4 illustrates the spring clip 130 disposed within the underside of the retaining member 110. FIGS. 5A and 5B show the spring clip removed from the retaining member 110.

Figures 6A, 6B:
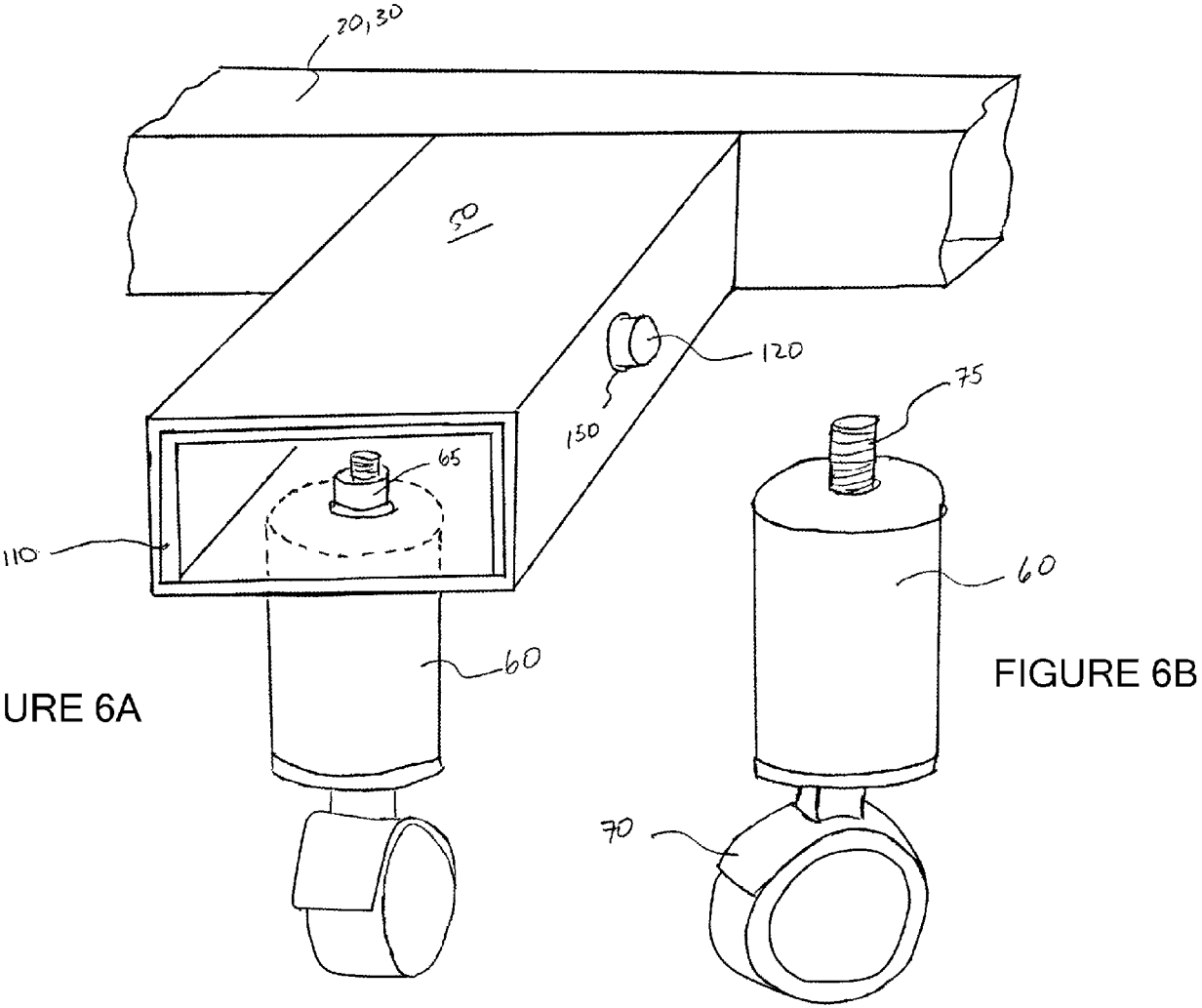
FIG. 6A is a perspective view along line 6-6 of FIG. 1, illustrating the cross section of the cross support bar in engagement with the retaining member.
FIG. 6B is a perspective view of one embodiment of a support leg for the bed frame assembly.

In one embodiment, as illustrated in FIG. 1, the bed frame assembly 10 is supported on legs 60 which are connected to casters 70. Legs 60 are connected to the underside of the cross support members 50 via a threaded coupling mechanism 65 which extends into the tubular cross section (FIGS. 6A, 6B). Legs 60 have a threaded shaft 75 which is threaded into the coupling mechanism 65 to secure the leg 60 to the underside of the cross support bar 50. Because the retaining members is an inverted U-shape, the threaded shaft is able to extend into the tubular space of the cross support bar. In an alternate embodiment, the legs 60 maybe connected to the underside of the cross support members 50 permanently, such as by welding the legs 60 to the underside of the cross support member 50.

Figure 7:
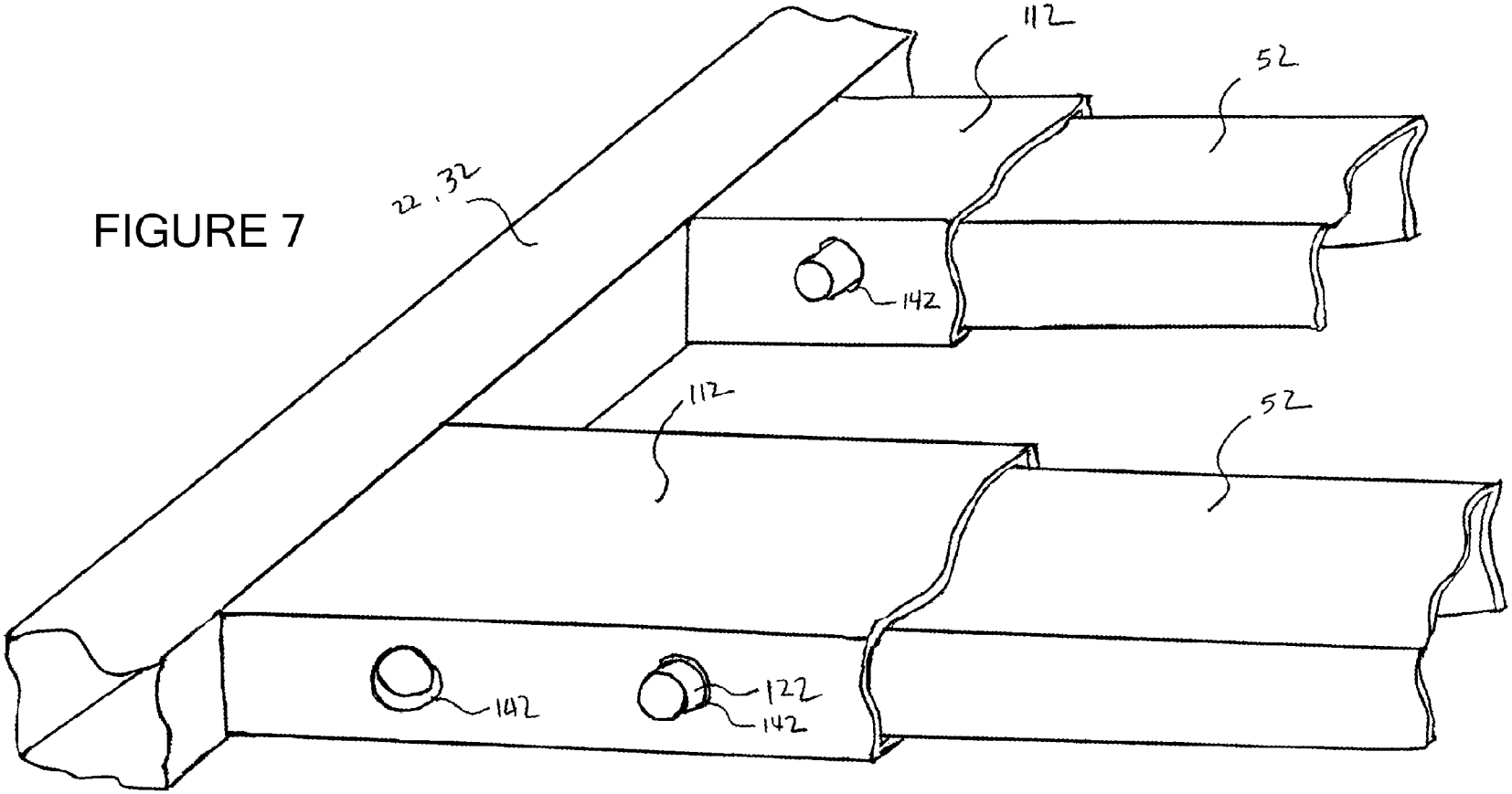
FIG. 7 is a perspective view of an alternate embodiment of the bed frame assembly.

In an alternate embodiment as illustrated in FIG. 7, the releasable joint can be formed by a retaining member which is tubular 112 and a cross support member 52 which is an inverted U-Shape. Cross support member 52 can house a spring clip with protrusions in the same fashion as the inverted U-shaped retaining member. Protrusions extending from the inverted U-shaped cross-support member 52 engage with apertures on the retaining member 112. The retaining member can have one aperture or a plurality of apertures which correspond to positions allowing for the adjustment of the cross-support length. Apertures on the retaining member correspond to desired positioning of the cross support member to provide the desired cross support length to suit the type of mattress desired.

Figure 8:
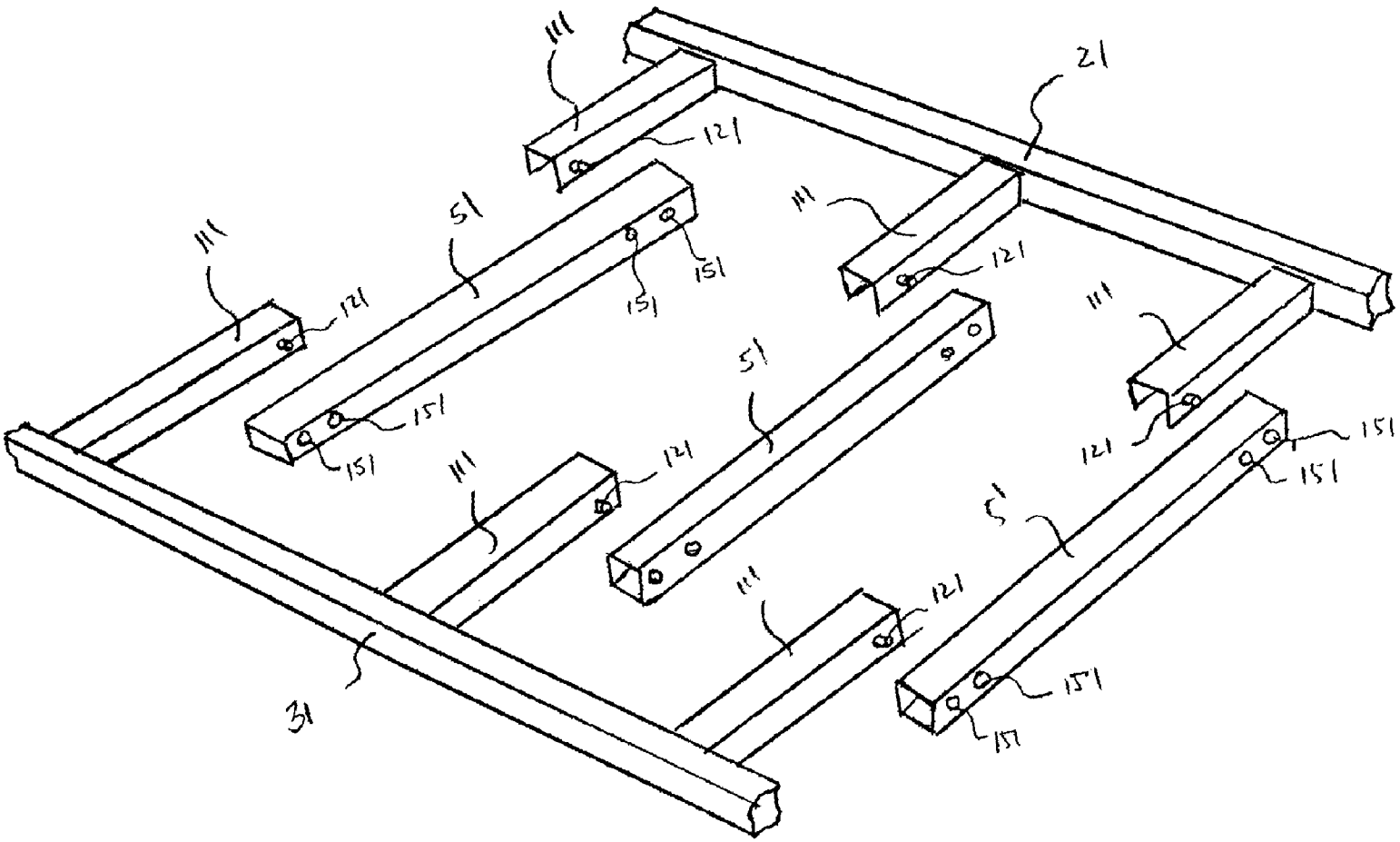
FIG. 8 is an exploded view of yet another alternate embodiment of the bed frame assembly.
Figure 9:
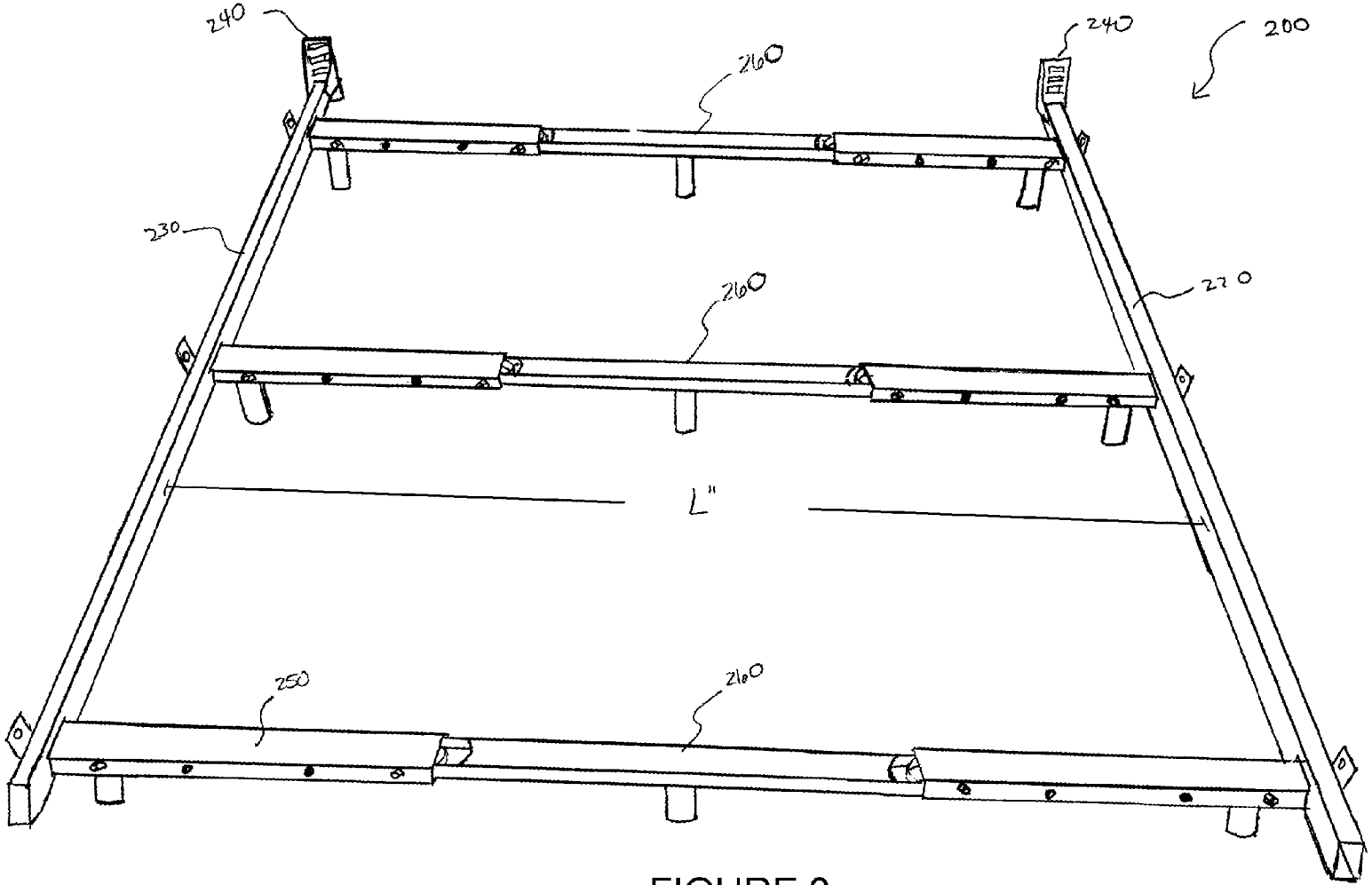
FIG. 9 is a perspective view of an alternate embodiment of an adjustable bed frame assembly with portions of the central cross support member removed for clarity to illustrate the spring clips
Figure 10:
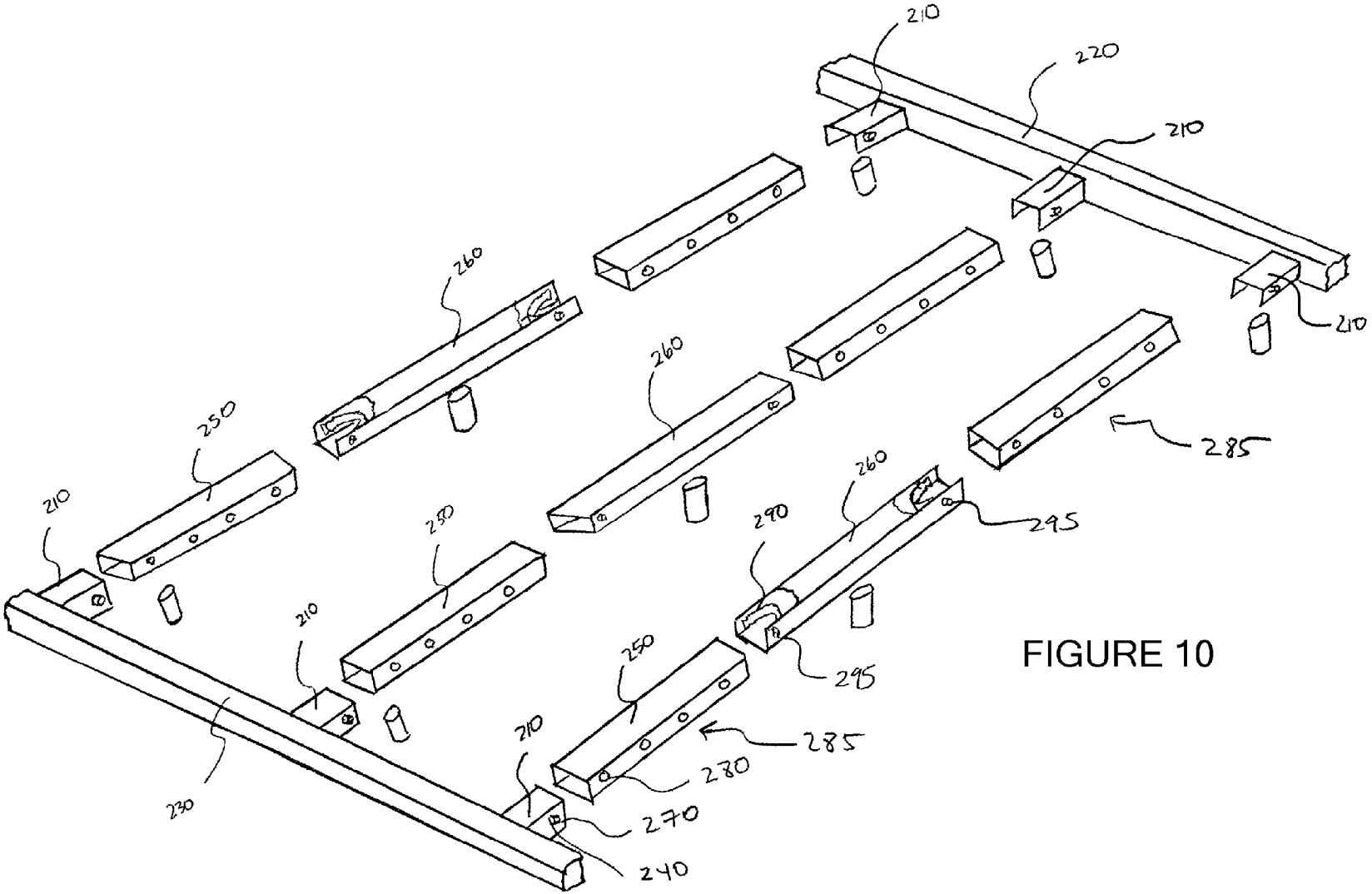
FIG. 10 is an exploded view of the adjustable bed frame assembly of FIG. 9 with portions of the central cross support member removed for clarity.

FIGS. 8-10 illustrate embodiments of an adjustable bed frame utilizing the releasable joint mechanism as described above. The retaining members 111 of FIG. 8 extend further from the side rails 21, 31 towards each other to engage with a length adjustment member 51. An increased extension of the retaining members allows for a portion of the retaining member to contribute to the cross support length. The length adjustment members 51 are tubular and of a rectangular cross section. The rectangular cross section of the length adjustment members 51 are sized such that the retaining members 111 can fit within the cross sectional area of the length adjustment members 51, in a similar fashion as described with respect to FIG. 2. The length adjustment members 51 comprise positioning apertures 151. Positioning apertures 151 are engageable with protrusions 121. A positioning aperture 151 is selected for engagement with protrusions 121 depending on the desired cross-support length. As illustrated, two pairs of apertures 151 are disposed on either end of the length adjustment member 51. However, a plurality of apertures can be used and/or the length of the adjustment member 51 can be varied to provide desired cross-support length combinations.

FIGS. 9 and 10 illustrate yet another embodiment of an adjustable bed frame assembly. FIG. 9 illustrates the bed frame assembly in its assembled state, with a cross support length "L". FIG. 10 illustrates the adjustable bed frame assembly in an exploded view. FIG. 10 illustrates that cross support length "L" comprises at least the distances spanned by portions of the central cross support 260, and the side support cross member 250 which engages with the central cross support member 260 on either end of the central cross support member 260.

Side support cross members 250 have a cross sectional dimensions to allow retaining members 210 and central cross support members 260 to be fitted within the tubular shaft. Retaining members 210 extend in a direction towards each other from side rails 220, 230. Retaining members 210 are similar to retaining members as described with respect to FIG. 2, which comprise an inverted U-shaped structure with a spring clip disposed within the U-shaped groove. The spring clips 290 disposed within the U-shaped groove provide protrusions 270 which extend through apertures 240 in the retaining members 210. In one embodiment, the protrusions engage with the first positioning aperture 280 on the side support cross member 250. Alternatively, the retaining members can be further extended towards each other, such that the protrusions are able to engage with various positioning apertures in a manner as described with respect to FIG. 8. As illustrated in FIG. 10, adjustment of the cross-support length is made possible by varying the engagement of the central cross support member 260 with the side support cross members 250 disposed on either end of the central cross support member. The central cross support member 260 is an U-shaped structure similar to the retaining member 210, and may have the same dimensions as the retaining member, permitting the cross support member to be disposed within the tubular shaft of the side support cross member. The central cross support member comprises two spring clips which provide a pair of protrusions 295 on either end of the central cross support member. The protrusions on either end of the central cross support member are engageable with positioning apertures 285 on the side support cross members. The user selects the desired position aperture for engagement with the protrusion pairs 295 to arrive at the desired cross support length. In an alternate embodiment (not show) retaining member are not required and the side support cross members 250 extend from the support rails 220, 230 directly, in a manner similar to as illustrated in FIG. 8.

Figure 11:
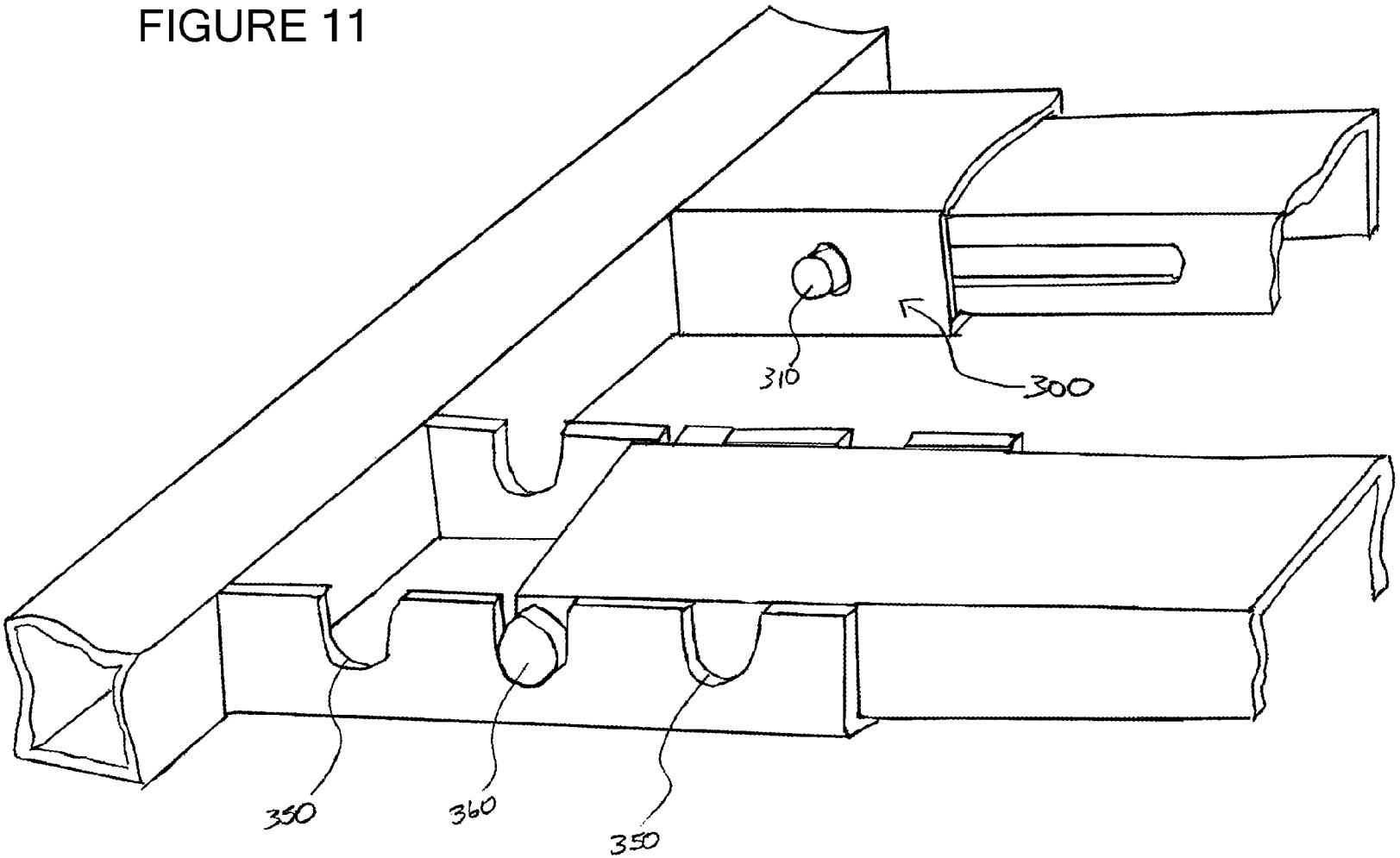
FIG. 11 is a perspective view of an adjustable bed frame assembly using alternate releasable joint mechanisms.
Figure 12:
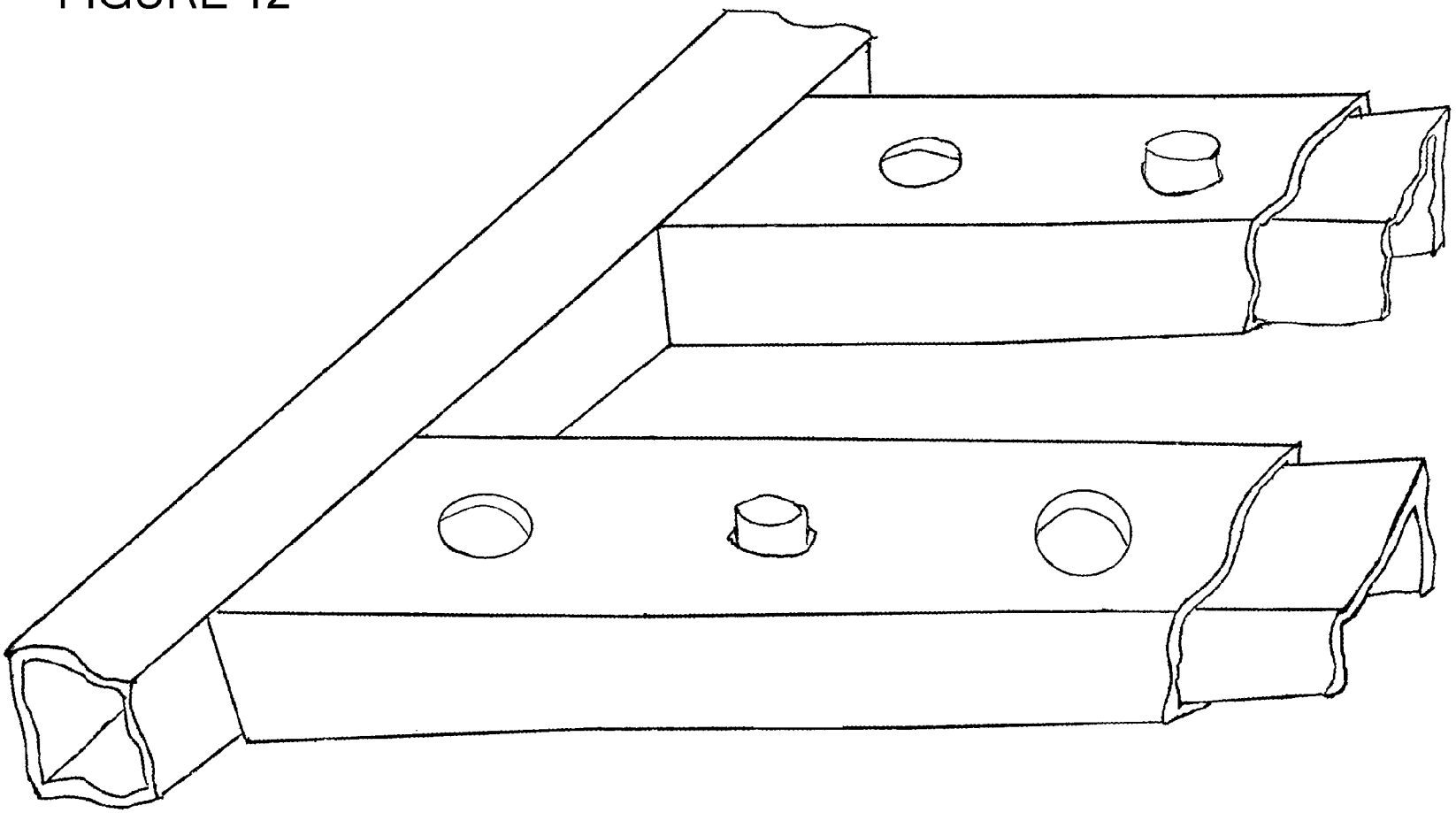
FIG. 12 is a perspective view of an alternate embodiment of the bed frame assembly.

Any suitable engagement mechanism can be used to form a releasable joint. Cross support members and retaining members may be joined using a threaded coupling mechanism. The threaded coupling mechanism can also be used to vary the length of the cross support distance. A slider link mechanism 300 as illustrated in FIG. 11 can also be used to adjust the cross support length. A fastening pin 310 can be used to secure the position of the cross support member once the desired distance has been selected. Alternatively, retaining member comprising positioning grooves 350 engagable with protrusions 360 on the end of a cross support member can also be used. Cross support members and/or retaining members can also be telescopic in nature to allow for adjustment to the cross support length. Other adjustable, releasable joint mechanisms can also be used.

In one embodiment, as illustrated in 12, the releasable joint may be on the bottom and top surfaces of the length adjustment member, side support cross member, the retaining member, or a cross support member. Alternatively, the protrusion need not protrude in pairs as when a spring clip is used. A one sided protrusion can be effectuated by having a protrusion extend on one end of a spring. In an alternate embodiment, protrusions can protrude into a tubular surface for engagement, such as when protrusions protrude in a direction towards each other.

Cross support members and retaining members may be tubular or U-shaped. Cross support members and retaining members may be of any cross sectional dimension that is complementary. For example, a cross support member with a circular cross section is engageable with a retaining member comprising a half-circle cross section. Cross support members and retaining members may both be tubular with the same cross sectional shape, with one component having a smaller cross sectional dimension than the other such that one member can be fitted within the other member.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein.

The invention claimed is:

1. A bed frame assembly which can be assembled and disassembled without the use of tools, comprising:

at least two side rails spaced a distance apart and arranged parallel to each other;

a plurality of cross support members spanning at least a portion of the distance between the side rails; and a plurality of retaining members extending towards each other from the two side rails, each of the plurality of retaining members configured to connect to one of the plurality of cross support members with a releasable joint mechanism;

each releasable joint mechanism comprises at least two protrusions, one or more protrusions positioned on each of two different sides of at least one of the cross support members or the retaining members, and at least two corresponding apertures positioned on the other of the cross support members or the retaining members to receive the protrusions each protrusion, movable between an extended position and a retracted position.

2. The bed frame assembly of claim 1, wherein the protrusions are disposed on the cross support members and the apertures are disposed the retaining members.

3. The bed frame assembly of claim 1, wherein the protrusions are located at opposite ends of a spring clip.

4. The bed frame assembly of claim 1, wherein either the retaining members have an inverted U-shape cross section and the cross support member have a rectangular cross-section, or the cross support members have an inverted U-shape cross section and the retaining members have a rectangular cross-section.

5. The bed frame assembly of claim 4, wherein the U-shape cross section has a dimension that is less than the dimension the rectangular cross section such that the U-shape cross section can be disposed within the rectangular cross section.

6. The bed frame assembly of claim 1, wherein at least one of the apertures has an open side.

7. The bed frame assembly of claim 1, wherein the at least two apertures comprise at a first group of apertures and a second group of apertures, each group of apertures comprising at least two apertures; the first group spaced longitudinally apart from the second group of apertures—along the cross support member or the retaining member, the protrusions selectively engageable with the first or second group of apertures to vary a distance which the cross support member spans between the side rails.

8. The bed frame assembly of claim 1, wherein the protrusions are positioned on opposite sides of one of the cross support members or the retaining members and the apertures are located on opposite sides of the other of the cross support members or the retaining members.

9. The bed frame assembly of claim 1, wherein the retractable protrusions are located at opposite ends of a substantially v-shaped spring.

10. The bed frame assembly of claim 1, wherein the protrusions are formed adjacent ends of a unitary substantially v-shaped spring, the v-shaped spring is positioned within a hollow channel of the cross support member or the retaining member, and the ends of the spring are biased away from each other a distance further than the width of the of the cross support member or the retaining member within which the spring is disposed.

11. The bed frame assembly of claim 1, wherein a first end of at least one cross support member is connectable to a first retaining member of the plurality of retaining members from a first side rail of the at least two side rails and a second end of the at least one cross support member is connectable to a second retaining member of the plurality of retaining members from a second rail of the at least two side rails opposite the first side rail; each of the first end and the second end of the at least one cross support member connectable to the respective retaining member with one of the releasable joint mechanisms.

12. The bed frame assembly of claim 1, comprising at least one intermediate cross member, the intermediate cross member configured to connect with at least one of the cross support members with at least one intermediate releasable joint mechanism, at least one intermediate releasable joint mechanism comprises at least two protrusions on one of the cross support members or the intermediate cross member, and at least two corresponding apertures positioned on the other of the cross support members or intermediate cross member, each protrusion movable between an extended position and a retracted position.

13. A bed dame assembly which can be assembled and disassembled without the use of tools, comprising:

two tubular side rails spaced a distance apart and arranged parallel to each other;

a plurality of cross support members spanning at least a portion of the distance between the tubular side rails; and plurality of retaining members extending towards each other from the two tubular side rails, the plurality of retaining members connected to the plurality of cross support members via a releasable point mechanism, the releasable joint mechanism comprises retractable protrusions disposed on the retaining member which interlock with apertures disposed on the cross support member.

14. An adjustable bed frame assembly which can be assembled without the use of tools, comprising:

at least two side rails spaced a cross support length apart and arranged parallel to each other;

a plurality of cross support members spanning at least a portion of the cross support length between the side rails; and a plurality of retaining members extending towards each other from each of the at least two side rails, each of the plurality of retaining members configured to connect to at least one of the plurality of cross support members via a releaseable joint mechanism, each releasable mechanism comprises at least two retractable protrusions disposed on one of the cross support members or the retaining members which releasablely interlock with apertures disposed on the other of the cross support members or the retaining members;

the at least two retractable protrusions are located opposite ends of a spring.

15. The bed frame assembly of claim 14, wherein the apertures are located on the cross support member and the retractable protrusions are located on the retaining member.

16. The bed frame assembly of claim 14, wherein the at least two apertures comprise at a first group of apertures and a second group of apertures, each group of apertures comprising two apertures; the first group spaced apart from the second group of apertures along the cross support member or the retaining member, the prolusions selectively engageable with the first or second group of apertures to vary a distance which the cross support member spans between the side rails.

17. A method of assembling a bed frame with two side rails spaced a cross support distance apart, a plurality of retaining members which extend from the two side rails, and a plurality of cross support members configured to span at least a portion of the cross support distance, comprising the steps of:

providing at least two spring biased protrusions, one or more protrusions positioned on each of at least two different sides of at least one of the cross support members or the retaining members;

providing apertures, configured to receive the protrusions, on the other of the cross support members or the retaining members;

forcing the at least two spring biased protrusions to a recessed position;

moving either or both of the protrusions and apertures relative to the other so that the protrusions register with the apertures to form the joint between at least one of the cross support members and at least one of the retaining members.

18. The method of claim 17, wherein the step of moving, comprises the step of sliding the retaining member into a cross sectional hollow space of the cross support member until protrusions, being located on the retaining member, register with the apertures, being located cm the cross support member.

19. The method of claim 17 wherein the step of moving comprises the step of sliding the cross support member into a hollow cross sectional space of the retaining member until protrusions, being located on the cross support member, register with the apertures, being located on the retaining member.

20. The method of claim 17, wherein the step of moving comprises the step of moving the protrusions toward the apertures and interlocking the protrusions into the apertures where the protrusions spring to art extended position.

21. The method of claim 17, wherein the step of forcing is further defined in that the protrusions are moved transversely to the recessed position; and wherein the step of moving is further defined in that either or both of the protrusion and apertures are moved longitudinally relative to the other of the protrusion and apertures.

* * * * *